US011766689B2

(12) United States Patent
Baumgartner et al.

(10) Patent No.: US 11,766,689 B2
(45) Date of Patent: Sep. 26, 2023

(54) PROGRAMMABLE NETWORKED VARIABLE ATOMIZER (PNVA) SYSTEM

(71) Applicant: Lincoln Global, Inc., Santa Fe Springs, CA (US)

(72) Inventors: Toby L. Baumgartner, Canal Winchester, OH (US); Jason A. Hoffman, Cable, OH (US); Tyler J. Viers, Gahanna, OH (US); Matthew P. Shockley, Waldo, OH (US); Robert E. Ewing, Columbus, OH (US)

(73) Assignee: LINCOLN GLOBAL, INC., Santa Fe Springs, CA (US)

( * ) Notice: Subject to any disclaimer, the term of this patent is extended or adjusted under 35 U.S.C. 154(b) by 239 days.

(21) Appl. No.: 17/464,751

(22) Filed: Sep. 2, 2021

(65) Prior Publication Data

US 2021/0394215 A1 Dec. 23, 2021

Related U.S. Application Data

(62) Division of application No. 16/942,897, filed on Jul. 30, 2020, now abandoned.

(60) Provisional application No. 62/925,942, filed on Oct. 25, 2019.

(51) Int. Cl.

| | |
|---|---|
| ***B05B 12/06*** | (2006.01) |
| ***B05B 7/04*** | (2006.01) |
| ***B05B 12/00*** | (2018.01) |
| ***B05B 7/12*** | (2006.01) |

(52) U.S. Cl.

CPC ..... *B05B 12/06* (2013.01); *B05B 7/0475* (2013.01); *B05B 7/12* (2013.01); *B05B 12/008* (2013.01)

(58) Field of Classification Search

CPC ..... B05B 12/00; B05B 12/06; B05B 7/0475; B05B 7/12; B05B 12/008

USPC ..... 239/290, 297, 69; 72/41, 43, 45

See application file for complete search history.

(56) References Cited

U.S. PATENT DOCUMENTS

| | | | | |
|---|---|---|---|---|
| 4,721,150 | A * | 1/1988 | Thurner | B22D 17/2007 239/304 |
| 5,125,480 | A | 6/1992 | Gregory et al. | |
| 5,435,373 | A | 7/1995 | Drane et al. | |
| 5,531,085 | A | 7/1996 | Hayes | |
| 5,584,361 | A | 12/1996 | Cisko et al. | |
| 5,878,960 | A | 3/1999 | McInerney, II et al. | |

(Continued)

FOREIGN PATENT DOCUMENTS

| | | |
|---|---|---|
| CN | 203155910 U | 8/2013 |
| CN | 205253450 U | 5/2016 |

(Continued)

OTHER PUBLICATIONS

Production Resources, Inc.; "Pax In-Die Automatic Lubrication System;" Dated Nov. 27, 2019; pp. 1-2.

*Primary Examiner* — Steven J Ganey
(74) *Attorney, Agent, or Firm* — David J. Muzilla

(57) ABSTRACT

A programmable networked variable atomizer (PNVA) assembly is provided. In one embodiment, the PNVA assembly includes an atomizing portion. The atomizing portion includes multiple miniature fluid control valves and an air assisted atomizing outlet. The PNVA assembly also includes a PNVA electronic module. The PNVA electronic module includes a microcontroller, at least one pulse width modulation driver, a wireless radio, a differential pressure sensor, and a laser targeting LED.

10 Claims, 7 Drawing Sheets

(56) References Cited

U.S. PATENT DOCUMENTS

| | | | | |
|---|---|---|---|---|
| 8,118,018 | B1 * | 2/2012 | Sherment | B28D 1/046 451/352 |
| 10,773,271 | B2 * | 9/2020 | Funseth | A01M 7/0089 |
| 2002/0063018 | A1 | 5/2002 | Schippers | |
| 2007/0079641 | A1 | 4/2007 | Doi et al. | |
| 2007/0137985 | A1 | 6/2007 | Beauchamp | |
| 2010/0161142 | A1 | 6/2010 | Guenther | |
| 2012/0132303 | A1 | 5/2012 | Conley et al. | |
| 2013/0055544 | A1 * | 3/2013 | Symonds | B05B 13/0654 118/318 |

FOREIGN PATENT DOCUMENTS

| | | | |
|---|---|---|---|
| DE | 41 36 982 | A1 | 5/1993 |
| JP | H09-066331 | A2 | 3/1997 |
| WO | 2015020644 | A1 | 2/2015 |

* cited by examiner

PROGRAMMABLE NETWORKED VARIABLE ATOMIZER (PNVA) SYSTEM

CROSS REFERENCE TO RELATED APPLICATION/INCORPORATION BY REFERENCE

This U.S. patent application is a divisional patent application of U.S. patent application Ser. No. 16/942,897 filed on Jul. 30, 2020, and which claims priority to and the benefit of U.S. provisional patent application Ser. No. 62/925,942 filed on Oct. 25, 2019, both of which are incorporated herein by reference in their entirety.

FIELD

Embodiments of the present invention relate to atomizers used in the die-casting, forging, and foundry industries. More specifically, embodiments of the present invention relate to Programmable Networked Variable Atomizer (PNVA) systems and assemblies.

BACKGROUND

Many die casting machines use atomizers mounted on a robot arm to deliver lubricants to the die face. These atomizer outlets range in volume of lubricant delivered and total quantity that make up the system, dependent on the tooling being run in the machine. The nozzles can be fixed hydraulic atomizers or air assisted atomizers, and both types can be difficult to setup to a particular process because all adjustments are manual. In addition, in large systems, it is hard to track down a problem such as a malfunctioning atomizer or plugged nozzle outlet.

SUMMARY

Embodiments of Programmable Networked Variable Atomizer (PNVA) systems and assemblies are disclosed. In one embodiment, control information and feedback information can be wirelessly communicated to and from a spray nozzle. The proper functioning of an atomizer can be determined by using sensors on the atomizer. Adjustable atomizer flow patterns are provided by controlling solenoids within the atomizer. Embedded lasers ensure that the atomizers are targeted correctly. A manifold is provided that features built in routings for control signals. The atomizers attach to the manifold and the wiring that is built into the manifold allows the atomizers at least to turn on and off.

One embodiment of the present invention includes a Programmable Networked Variable Atomizer (PNVA) system having 1.) a single or a plurality of sensors (e.g., a single differential pressure sensor) for detecting plugged conditions and verifying flowrate of each atomizer, 2.) a single or a plurality of solenoids (e.g., three solenoids) that operate on a control signal(s) that adjust(s) lubricant flow rate, atomizing air flow rate, and adjusts the pattern from cone to fan, 3.) an embedded laser(s) for targeting the die face during setup, and 4.) a radio module that allows each PNVA to communicate over an independent wireless mesh network with an HMI (human machine interface)/PLC (programmable logic controller) (e.g., a digi/wifi/Bluetooth, etc.). For example, the radio module can be an Xbee radio module which is a wireless connectivity module, for example, designed for point-to-point and star communications. In accordance with one embodiment, an Xbee radio module is about the size of a U.S. quarter dollar coin. The mesh network can be, for example, a DIGIMesh network which is a proprietary wireless mesh network that allows for time synchronized sleeping nodes, low-power operation, and communication. All devices on a DIGIMesh network are of the same device type in the sense that every device is capable of routing, sleeping for power optimization, and communicating via a mesh network.

In one embodiment, the PNVA system allows the end user to answer the following questions at each outlet: 1.) Did the outlet open when it was supposed to open? 2.) Did the outlet close when it was supposed to close? 3.) Is the system aimed correctly? (i.e., hitting what it is supposed to hit) 4.) Flow rate confirmed? All of this information is available over the mesh network eliminating much sensor or communication cabling. In one embodiment, the PNVA system uses a wireless (e.g., DIGIMesh) network to communicate to any number of atomizers in a die casting spray system. The PNVAs use solenoids to control the working fluids, with a front end nozzle that can switch between cone or fan patterns based on the command received. In one embodiment, the solenoids are controlled with a pulse width modulation (PWM) signal. These atomizers also communicate, back to a controller (e.g., a PLC/HMI), a confirmation of commanded flow rate and health status which flag plugged or broken conditions (e.g., solenoid coil failure, physical impediments, electrical errors).

One embodiment is a programmable networked variable atomizer (PNVA) assembly. The PNVA assembly includes an atomizing portion, where the atomizing portion includes multiple miniature fluid control valves and an air assisted atomizing outlet. The PNVA assembly also includes a PNVA electronic module, where the PNVA electronic module includes a microcontroller, at least one pulse width modulation driver, a wireless radio, a differential pressure sensor, and a laser targeting LED. In one embodiment, the plurality of miniature fluid control valves includes a first solenoid valve that opens to allow a lubricating cooling fluid to flow, a second solenoid valve that opens to allow a primary atomizing air to flow, and a third solenoid valve that controls the air assisted atomizing output to provide a pattern of working fluids output by the PNVA to be a cone pattern, a narrow fan pattern, or a wide fan pattern. In one embodiment, the PNVA assembly includes a diagnostic package of computer-executable instructions executed by the microcontroller. The diagnostic package and the differential pressure sensor are configured to determine a flow rate during operation and detect plugging within the atomizing portion. In one embodiment, the differential pressure sensor compares actual flow rate to a commanded flow rate as part of determining plugging or reduced performance of the atomizing portion. In one embodiment, the differential pressure sensor monitors the atomizing portion for leaks during a commanded "no spray" mode of operation. In one embodiment, the pulse width modulation drivers control the multiple miniature fluid control valves. In one embodiment, the wireless radio provides wireless communication of the PNVA assembly over a wireless network. In one embodiment, the laser targeting LED supports targeting of a die face for delivery of working fluids.

One embodiment is a die casting spray system. The die casting spray system includes a human-machine interface, an edge control device including a programmable logic controller (PLC), a gateway coordinator device creating a mesh network that is closed to devices that do not have an identifier of the gateway coordinator device, and a PNVA system including multiple PNVA assemblies mounted to a distribution system of manifold blocks having passageways for air and lubricating fluids. In one embodiment, the gateway coordinator device includes a microprocessor, a printed circuit board, a mesh network device, and a communication module. In one embodiment, each PNVA assembly of the multiple PNVA assemblies is controlled wirelessly through the mesh network created by the gateway coordinator device. In one embodiment, each PNVA assembly of the multiple PNVA assemblies receives wired electrical power and ground via the distribution system of manifold blocks. In one embodiment, the mesh network is a 2.4 Ghz network. In one embodiment, a user can assign individual identifiers of the plurality of PNVA assemblies to the identifier of the gateway coordinator device either by pushing the momentary push button on the PNVA or by using a unique MAC address of the PNVA. In one embodiment, each PNVA assembly of the plurality of PNVA assemblies includes an atomizing portion and a PNVA electronic module. In one embodiment, the PNVA electronic module includes a microcontroller, at least one pulse width modulation driver, a wireless radio, a differential pressure sensor, a laser targeting LED, a diagnostic LED, and a momentary pushbutton. In one embodiment, the atomizing portion includes multiple miniature fluid control valves and an air assisted atomizing outlet. In one embodiment, a pattern of working fluids output by the air assisted atomizing outlet of each PNVA assembly of the multiple PNVA assemblies can be set independently, regardless of physical position on the distribution system of manifold blocks.

Numerous aspects of the general inventive concepts will become readily apparent from the following detailed description of exemplary embodiments, from the claims, and from the accompanying drawings.

BRIEF DESCRIPTION OF THE DRAWINGS

The accompanying drawings, which are incorporated in and constitute a part of the specification, illustrate various embodiments of the disclosure. It will be appreciated that the illustrated element boundaries (e.g., boxes, groups of boxes, or other shapes) in the figures represent one embodiment of boundaries. In some embodiments, one element may be designed as multiple elements or that multiple elements may be designed as one element. In some embodiments, an element shown as an internal component of another element may be implemented as an external component and vice versa. Furthermore, elements may not be drawn to scale.

DETAILED DESCRIPTION

Figure 1:
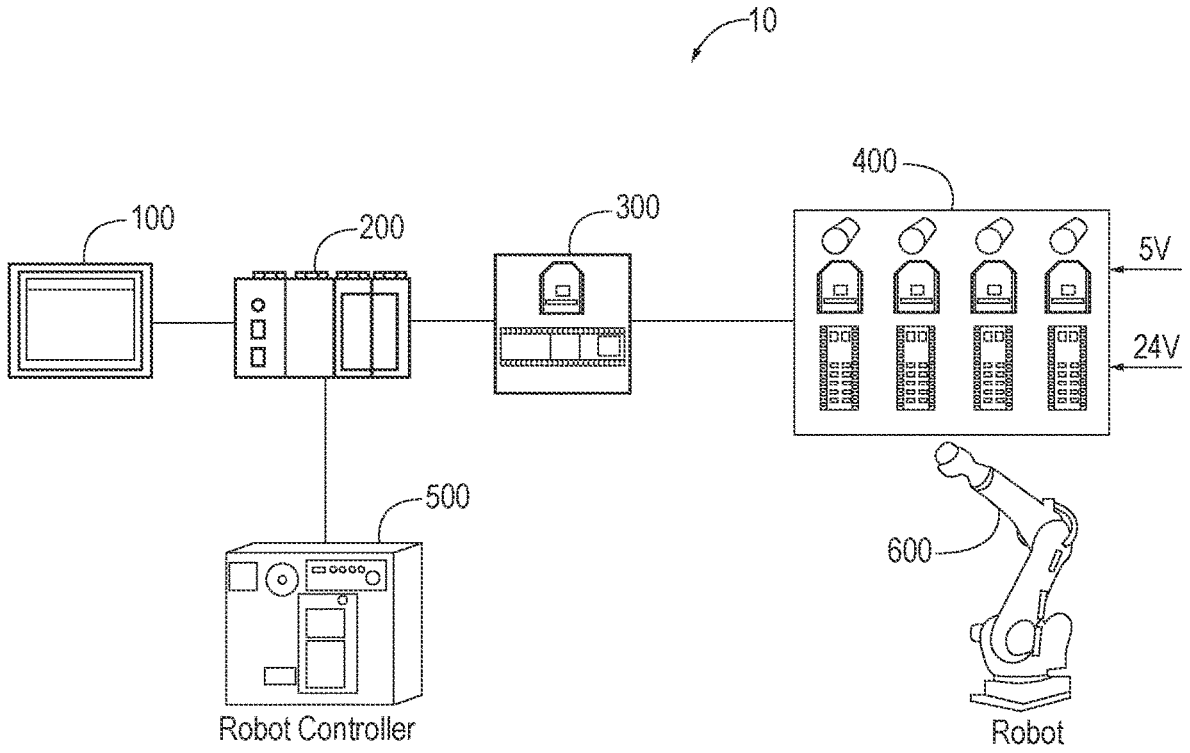
FIG. 1 illustrates one embodiment of a die casting spray system having a PNVA system having multiple PNVA assemblies.

Embodiments of the present invention include a control scheme and atomizing valve (PNVA) for the purpose of cooling and lubricating dies using atomizing air and water, oils, or other lubricating mixes. In accordance with various embodiments, control information and feedback information can be wirelessly communicated to and from a spray nozzle. The proper functioning of an atomizer can be determined by using sensors on the atomizer. Adjustable atomizer flow patterns are provided by controlling solenoids within the atomizer. Embedded lasers ensure that the atomizers are targeted correctly. Other non-contact devices may be used to determine an individual position of the spray outlet relative to a workpiece, in accordance with other embodiments. A manifold is provided that features built in routings for control signals. The atomizers attach to the manifold and the wiring that is built into the manifold allows the atomizers to turn on and off, etc.

The examples and figures herein are illustrative only and are not meant to limit the subject invention, which is measured by the scope and spirit of the claims. Referring now to the drawings, wherein the showings are for the purpose of illustrating exemplary embodiments of the subject invention only and not for the purpose of limiting same, FIG. 1 illustrates one embodiment of a die casting spray system 10 having a PNVA system 400 having multiple PNVA assemblies 400' (e.g., see FIG. 2).

Referring to FIG. 1, one embodiment of the die casting spray system 10 includes a human-machine interface (HMI) 100 (e.g., a touch-screen display), an edge control device 200 (e.g., in the form of a programmable logic controller (PLC)), a gateway coordinator device 300, the PNVA system 400, a robot controller 500, and a robot 600. In accordance with one embodiment, the gateway coordinator device 300 includes a microprocessor and a custom printed circuit board (PCB), a mesh network device (e.g., a DIGIMesh Network Xbee Device . . . i.e., a type of wireless radio), and a communication module (e.g., Ethernet IP, ProfiNET, or OPC-UA, depending on the nature of the PLC). Ethernet IP (industrial protocol) is an industrial network protocol that adapts the Common Industrial Protocol to standard Ethernet. ProfiNet is an industry technical standard for data communication over Industrial Ethernet. OPC-Unified Architecture (OPC-UA) is a machine-to-machine communication protocol for industrial automation.

Figure 2:
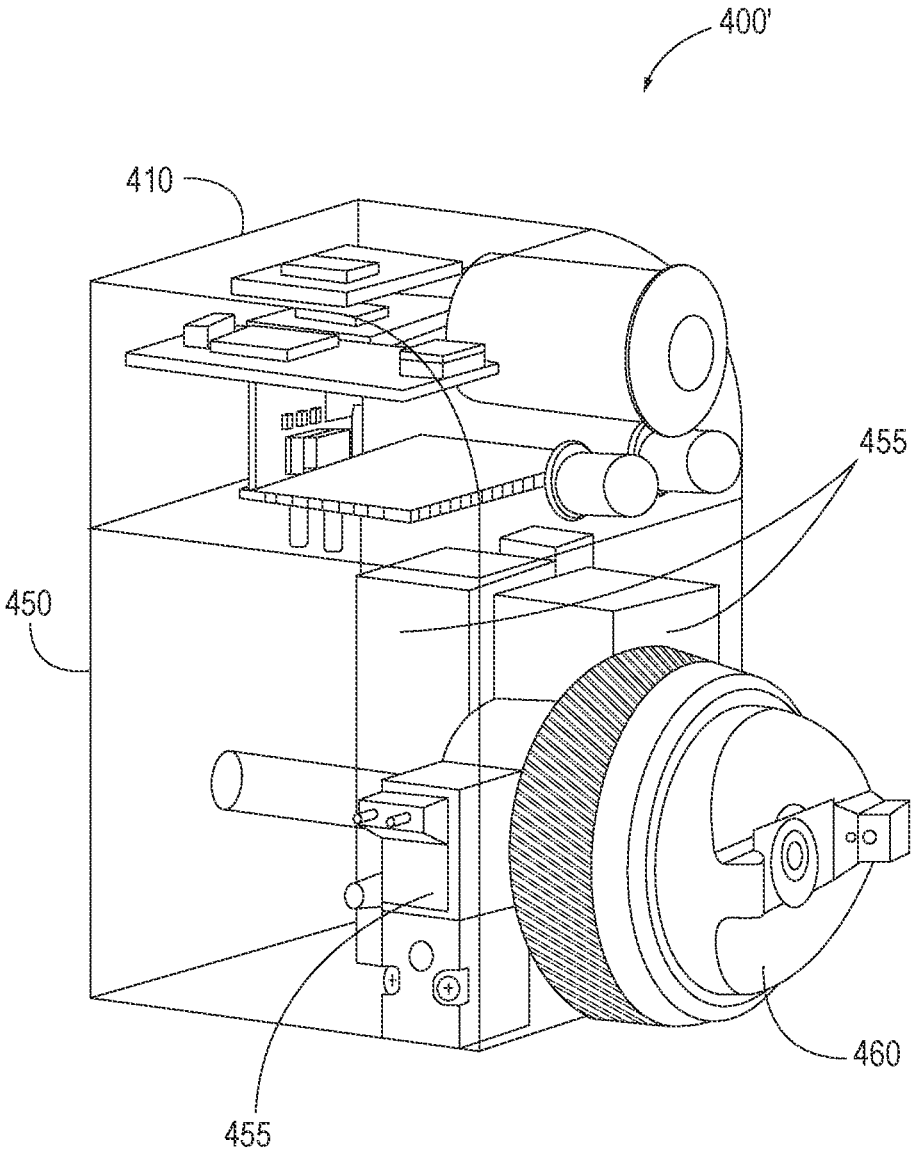
FIG. 2 illustrates one embodiment of a PNVA assembly of the PNVA system of FIG. 1.
Figure 3:
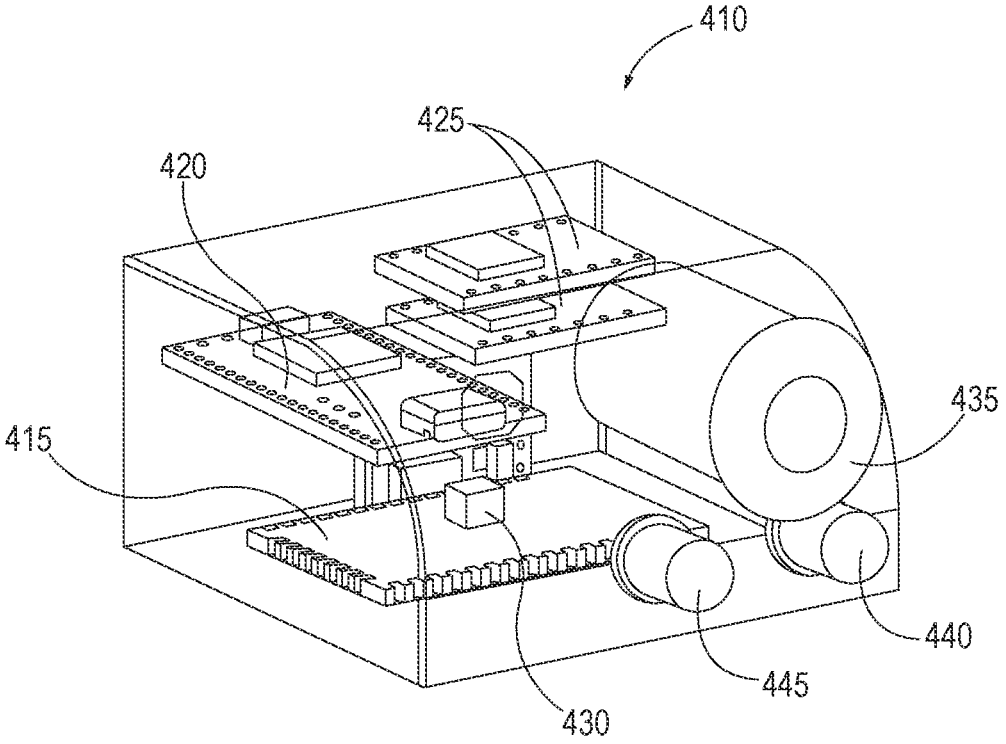
FIG. 3 illustrates one embodiment of a PNVA electronic module of the PNVA assembly of FIG. 2.

FIG. 2 illustrates one embodiment of a PNVA assembly 400' of the PNVA system 400 of FIG. 1. In one embodiment, the PNVA system 400 includes four (4) PNVA assemblies 400', each having a PNVA electronic module 410 and an atomizing portion 450. The atomizing portion 450 includes three miniature fluid control valves 455 (e.g., solenoid valves) and an air assisted atomizing outlet 460 (output spray nozzle). FIG. 3 illustrates one embodiment of a PNVA electronic module 410 of the PNVA assembly 400' of FIG. 2. In accordance with one embodiment, the PNVA electronic module 410 includes a mesh network device (e.g., a DIGIMesh Network Xbee device . . . i.e., a type of wireless radio) 415, a microprocessor and PCB 420 (i.e., a microcontroller), two custom pulse width modulator (PWM) driver PCBs 425 with three outputs for control valves, a differential pressure sensor 430, a momentary pushbutton 435, a laser diode (e.g., 5 mW) 440 (e.g., a laser targeting LED), and a diagnostic multiplexed LED 445. The differential pressure sensor 430 is important, in one embodiment, because being able to track flow rate on each individual nozzle for large systems in real time has previously been cost prohibitive. The laser targeting LED 440 supports targeting of a die face or other workpiece for delivery of working fluids. In accordance with other embodiments, other types of non-contact sensing devices may be used to determine an individual position of a PNVA assembly 400' relative to a die face or a workpiece.

Figure 4:
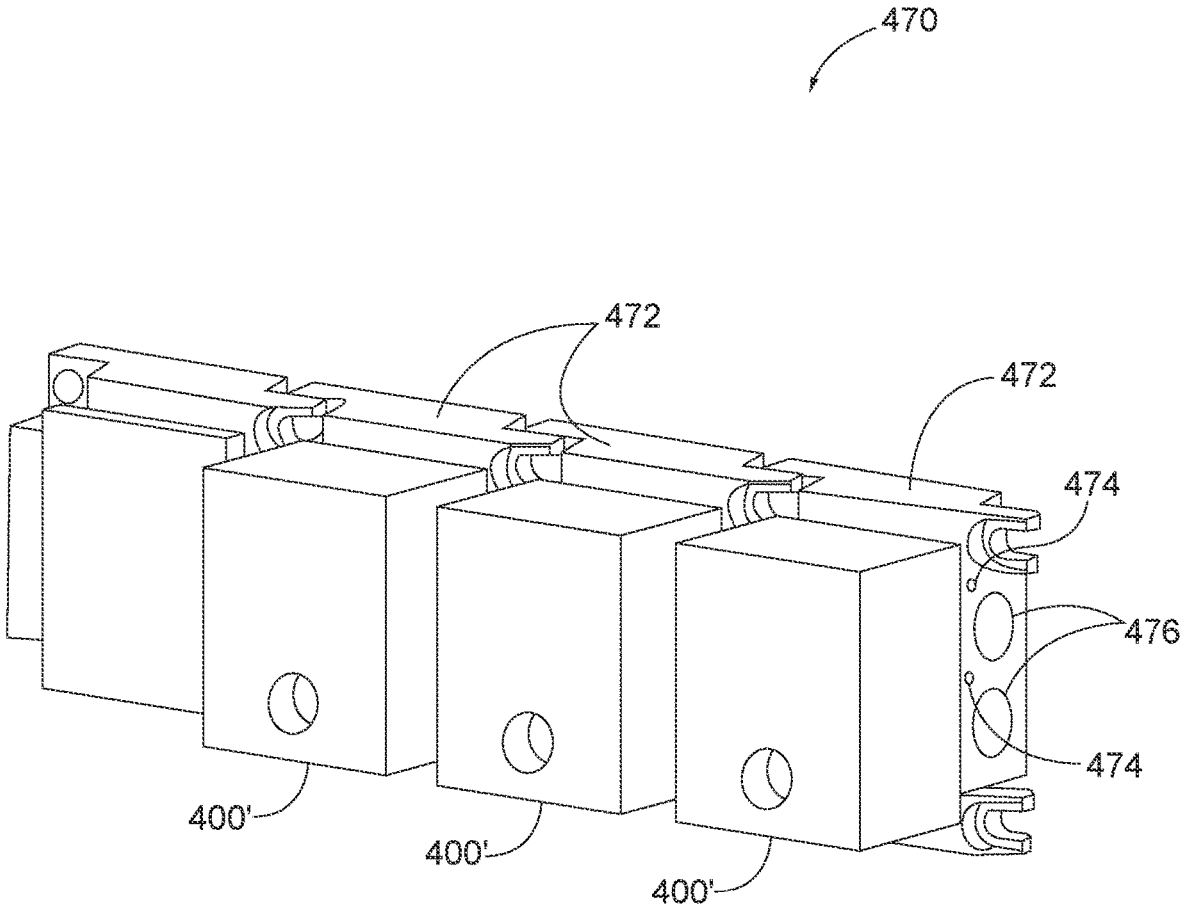
FIG. 4 illustrates one embodiment of a distribution system of the PNVA system of FIG. 1.

FIG. 4 illustrates one embodiment of a distribution system 470 of the PNVA system 400 of FIG. 1. The distribution system 470 includes manifold blocks 472 with passageways 476 for air and lubricating fluids as well as embedded built in routings for control signals, power (e.g., 24 VDC and/or 5 VDC), and ground 474. In accordance with one embodiment, each PNVA assembly 400' is configured to be mounted to the distribution system 470. A distribution system may be configured to have, for example, anywhere from one (1) to three hundred (300) PNVA assemblies 400' mounted thereto, depending on customer requests. For example, as seen in FIG. 4, four (4) PNVA locations for mounting PNVA assemblies 400' are shown, with one of the locations on the far left being empty (no mounted PNVA assembly).

Each PNVA assembly 400' receives wired electrical power (e.g., 24V and/or 5V) and ground to its own independent electronic module 410. The electronic module 410 includes a custom PCB with a microcontroller, PWM drivers, a DIGIMesh wireless radio, a differential pressure sensor, a laser targeting LED, a diagnostic LED, and a momentary pushbutton as discussed above herein. The PNVA assemblies 400' are controlled wirelessly through the DIGIMesh network (a type of wireless network) created by the gateway coordinator device 300. For example, control information and feedback information can be wirelessly communicated (as data) over the wireless network to/from the PNVA assemblies 400'. In one embodiment, the mesh network is a 2.4 Ghz network, but is completely closed to devices that do not have the personal area network identifier (PAN ID) of the gateway coordinator device. In one embodiment, there is one gateway coordinator device, and an unlimited amount of PNVA node devices per system. For sake of simplicity, users can assign individual PNVAs to a common group number either by pushing the momentary push button or by using its unique media access control (MAC) address. In one embodiment, the groups of nozzles can spray independent settings regardless of their physical position on the manifold. In addition there is no need for communication/control wires which aides in flexibly in mounting the atomizers (PNVA assemblies).

In one embodiment, the PNVA assemblies include a diagnostic package (e.g., computer-executable instructions to be executed by a microprocessor/microcontroller), the differential pressure sensor, and the LED light. By measuring the pressure before and after a precision hole in the lube passageway, the flow rate in the nozzle can be determined during operation, as well as detection of plugged nozzles (e.g., fully or partially blocked nozzles). During a spray operation, the PNVA uses the differential sensor to compare the actual flow to the commanded flow and will flag the user based on an escalation method if there is plugging or reduced performance. When "no spray" is commanded, the PNVA uses the sensor to monitor for leaking. Again, this method of using the differential pressure sensor is important, in one embodiment, because being able to track flow rate on each individual nozzle for large systems in real time has previously been cost prohibitive.

In one embodiment, there is a first solenoid valve that opens to allow the lubricating cooling fluid to flow, a second solenoid valve that opens to allow the primary atomizing air to flow, and a third solenoid valve that controls the pattern from a cone to a narrow fan or a wide fan. The patterns are manipulated by engaging different air towers in the atomizing air nozzle front end of the PNVA design. This allows the end user to have precision coverage without changing the nozzle manually, or spray different die features more effectively with the same nozzle. The PNVA system can be integrated with other non-die-casting equipment or automation equipment with a traditional PLC/HMI, for example.

Figure 5:
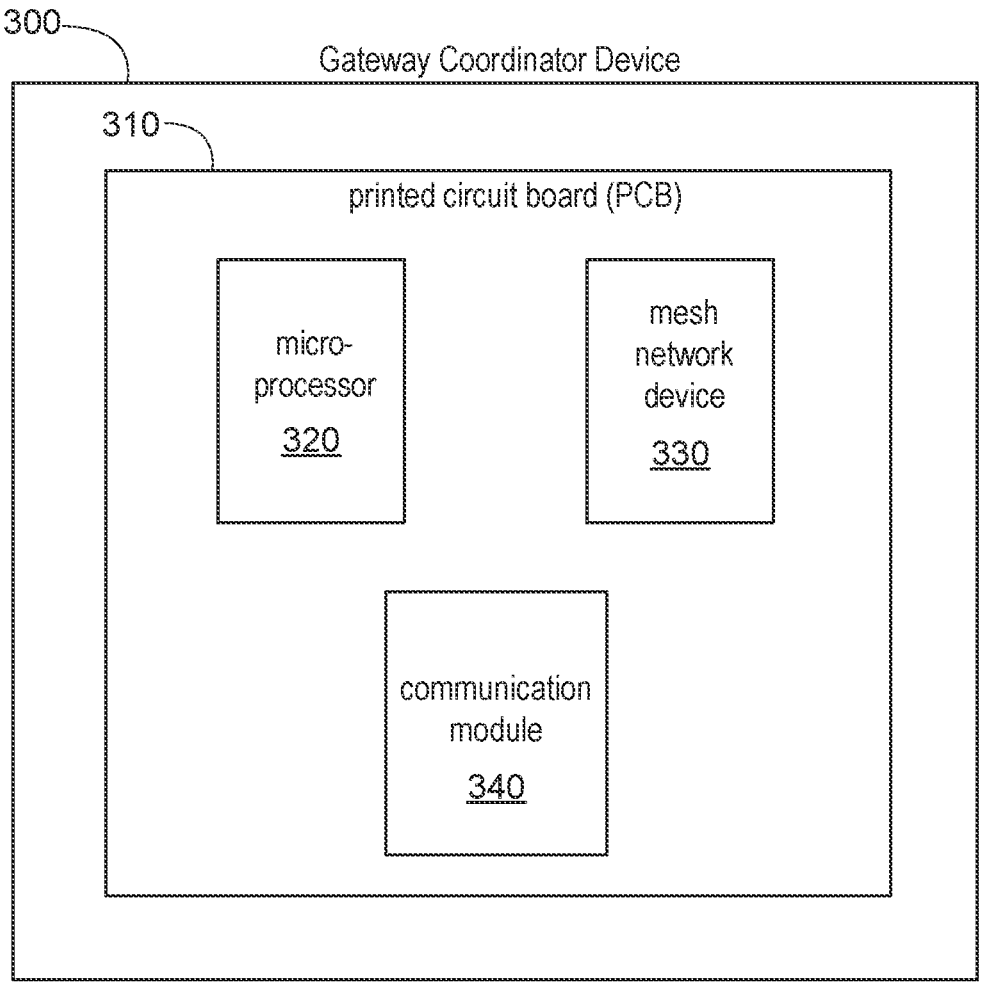
FIG. 5 illustrates one embodiment of a gateway coordinator device of FIG. 1.

FIG. 5 illustrates one embodiment of the gateway coordinator device 300 of FIG. 1. The gateway coordinator device 300 includes a printed circuit board (PCB) 310, a microprocessor 320, a mesh network device (i.e., a type of wireless radio) 330, and a communication module 340. The microprocessor 320 takes input commands from the PLC of the edge control device 200 and/or from the robot controller 500 and turns on outputs of each PNVA assembly 400'. The outputs control the volume and duration of the working fluid, the atomizing air, and the pattern (fan, cone, etc.), as well as the laser targeting LED 440. In one embodiment, the microprocessor 320 reads in data from the sensors in each PNVA assembly 400' and packages the data into a transmittable array (e.g., data packets) that can be sent to appropriate parts of the system.

The mesh network device 330 is a type of wireless device and acts as the communication link between each PNVA assembly 440' and the edge control device 200 and/or robot controller 500. In accordance with one embodiment, there is no processing or control software in the mesh network device 330. Instead, the mesh network device 330 simply sends and receives data packets (e.g., data packets of control information and feedback information). In one embodiment, the mesh network device 330 uses an off the shelf protocol referred to as DIGIMesh. The mesh network device 330 can be thought of as a replacement for an Ethernet cable assembly. For large lubrication systems, it becomes expensive and impractical to run individual control and communication wires to hundreds of PVNA assemblies (e.g., for real time individual flow rate control).

Figure 6:
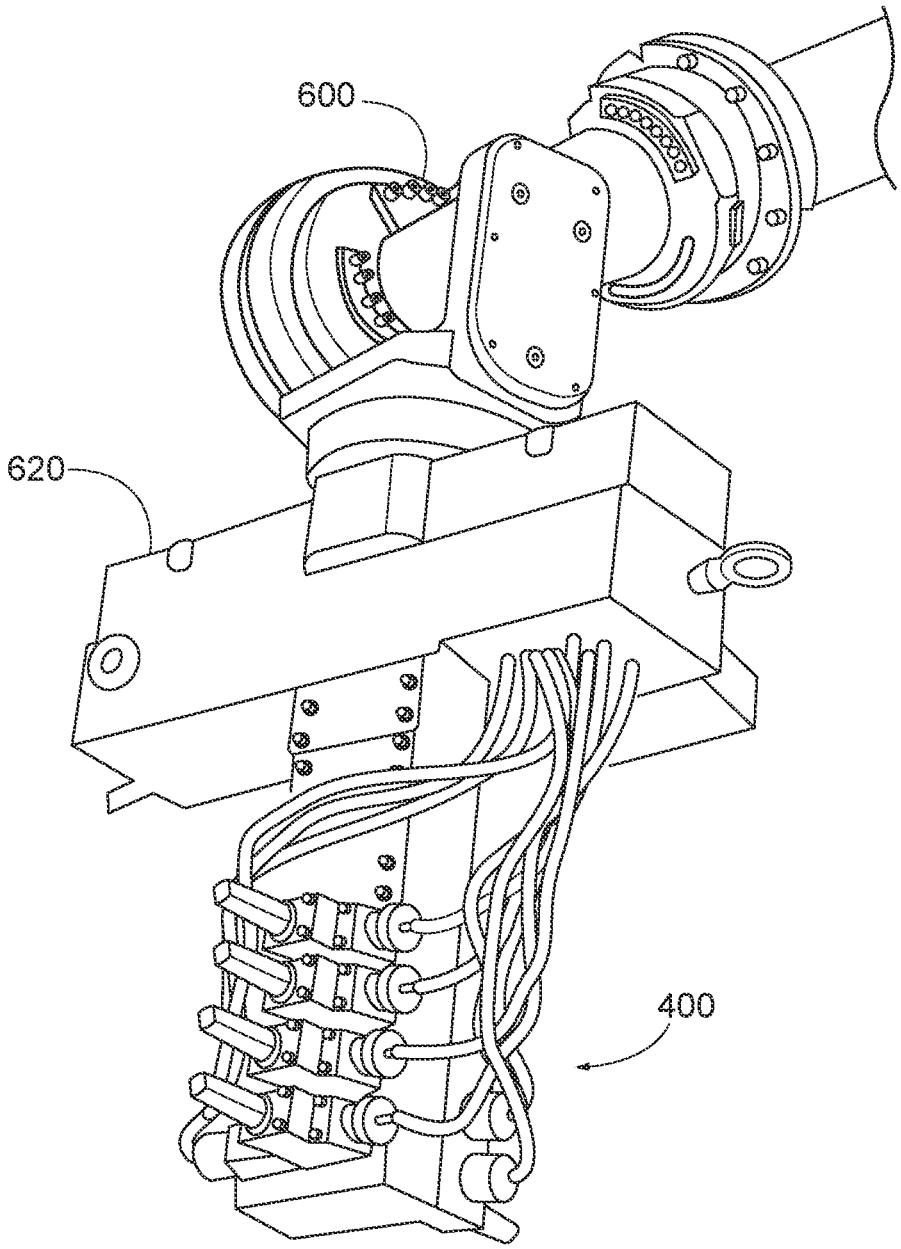
FIG. 6 illustrates one embodiment of how the PNVA system of FIG. 1 attaches to the robot in FIG. 1.

FIG. 6 illustrates one embodiment of how the PNVA system 400 of FIG. 1 attaches to the robot 600 in FIG. 1. The system is designed in a building block manner to be able to support hundreds of devices linked together. In one embodiment, the PNVA system 400 is mounted to the robot 600. The distribution system 470 attaches each single PNVA assembly 400' to the air, working fluid, and electrical power inputs as discussed above herein. The chain of manifold blocks of the distribution system 470 mount to a central hub 620 which attaches to an end of the robot 600 (e.g., on an arm of the robot).

In accordance with one embodiment, there may be multiple distribution systems 470 in an overall die casting spray system 10. Each distribution system 470 is associated with a unique DIGIMesh Network that has a single gateway coordinator device 300 assigned to it, and upon which all of the individual PNVA devices will communicate. Unique networks are assigned to the complete assembly of distribution blocks that attach to an individual robot (e.g., one robot, one network, an assembly of manifolds, and 1-300 individual PNVA's . . . all per die cast machine). The gateway coordinator device 300 may perform command functions in addition to transmitting data, and may keep track of the individual DIGIMesh devices embedded in each PNVA assembly 400'. In effect, the gateway coordinator device 300 acts as a master device and the PNVA assemblies 400' act as slave devices.

The edge control device 200 and/or the robot controller 500 may send a command to the gateway coordinator device 300. The microprocessor 320 in the gateway coordinator device 300 interprets the command and uses the mesh network device 330 to broadcast out to the PNVA assemblies 400'. The gateway coordinator device 300 is the hardware that actually creates the DIGIMesh network and assigns and removes the PNVA assemblies to a unique closed network. In one embodiment, the gateway coordinator device 300 can be used to wirelessly update the firmware of the DIGIMesh devices embedded in the PNVA assemblies 400'.

In one embodiment, the robot controller 500 uses an Ethernet communication protocol. The robot 600 has position and cycle information and is programmed to go to a location at a certain time at a certain speed and perform a certain function. The robot 600 and the robot controller 500 may communicate over a standard Ethernet protocol using a hardwired Ethernet cable connection, for example. Various types of communication from the robot may include verifying its presence, indicating that it is waiting for input, indicating that it performed a function, requesting that a function be performed, requesting to wait until it is done moving.

In one embodiment, the edge control device 200 (configured as a PLC) uses an Ethernet communication protocol over hardwired cable connections. The edge control device 200 is the main control hub which helps to integrate together the spray system controls (the gateway), the robot controls, and any other industrial equipment that is part of the system. That is, the PLC ties together all the different pieces of equipment into a common control point and is the supervisor of the entire system. In one embodiment, the edge control device 200 also connects to safety interlocks which are required for an Occupational Safety and Health Administration (OSHA) approved installation. The PLC uses a universally understood language and provides a software access point for any service person to hook into and easily pull diagnostic information or change program parameters. Whereas, the gateway and PNVA software and programming languages are, for example, proprietary and copyright protected. The edge control device 200 may be connected to the HMI device 100 which allows service personnel to look at data and diagnostic information in real time, without having to connect a computer to the system. The edge control device 200 takes outputs from the robot controller 500 and sends them out over Ethernet to the gateway coordinator device 300.

In one embodiment, the gateway coordinator device 300 uses Ethernet and wireless DIGIMesh protocols. The microprocessor 320 of the gateway coordinator device 300 is the front end of the gateway coordinator device 300. The microprocessor 320 receives command data over a hardwired Ethernet connection from the PLC of the edge control device 200. The microprocessor 320 converts the command data into a series of data that the PNVA assemblies 400' can understand. The communication module 340 of the gateway coordinator device 300 allows direct communication with an external computer via USB and internet connections, bypassing the PLC, for setting up the wireless network side of the system. The coordinator portion of the gateway coordinator device 300 creates the proprietary mesh network, having a special identification, over which all of the PNVA assemblies 400' will communicate. An external computer, connected to the gateway coordinator device 300, can "see" all of the end PNVA devices out on the network. In this way, certain parameters in the DIGIMesh portion of the PNVA assemblies 400' can be changed such as, for example, communication strength and speed. The PNVA assemblies can be assigned to communicate with the gateway coordinator device 300 and to each other. In accordance with one embodiment, there is only one gateway coordinator device 300 for each PNVA system 400. Again, the DIGIMesh portion of the gateway coordinator device 300 receives a data packet of commands from the microprocessor of the gateway coordinator device 300 and sends the commands to all of the PNVA assemblies 400' (end devices) of the PNVA system 400.

In one embodiment, a DIGIMesh portion of a PNVA assembly 400' is a wireless DIGIMesh chip that acts as a pass through. The wireless DIGIMesh chip has no "smarts" other than to receive and send data. The DIGIMesh portion of a PNVA assembly 400' receives a wirelessly broadcasted data packet and sends it to the input of the microcontroller 420 of the PNVA assembly 400'. The microcontroller 420 takes the data packet and converts it into useful commands. For example, only certain atomizers will be turned on at specific times, specific volumes, etc. The microcontroller 420 decides if it needs to turn on any atomizer outputs (valves) or not and completes the string of commands in the data packet. The microcontroller 420 will read the on board sensors collecting information on the power consumption, the working fluid consumption, and the health of the solenoids. This information is packaged into a data packet and sent back to the on board DIGIMesh portion of the PNVA assembly 400' along with YES/NO info with respect to whether the command was completed or not. The data packet is converted into the DIGI protocol and broadcast back (as feedback) to the DIGIMesh portion of the gateway coordinator device 300. The data packet is passed to the microprocessor 330 of the gateway coordinator device 300 which takes the data and converts it to useful information that can be analyzed and stored and sent to the PLC of the edge control device 200. The PLC will perform proofing to check that the data looks good, and perform process control checks, etc. The data may be written to an SD card, in accordance with one embodiment. The HMI device 100 is updated with any relevant parameters/settings for service personnel to review. In one embodiment, the edge control device 200 will then inform the robot controller when all is good and allow the robot 600 to be commanded by the robot controller 500 to perform a next task (or inform the robot controller that there is a problem and that the robot should not continue).

Figure 7:
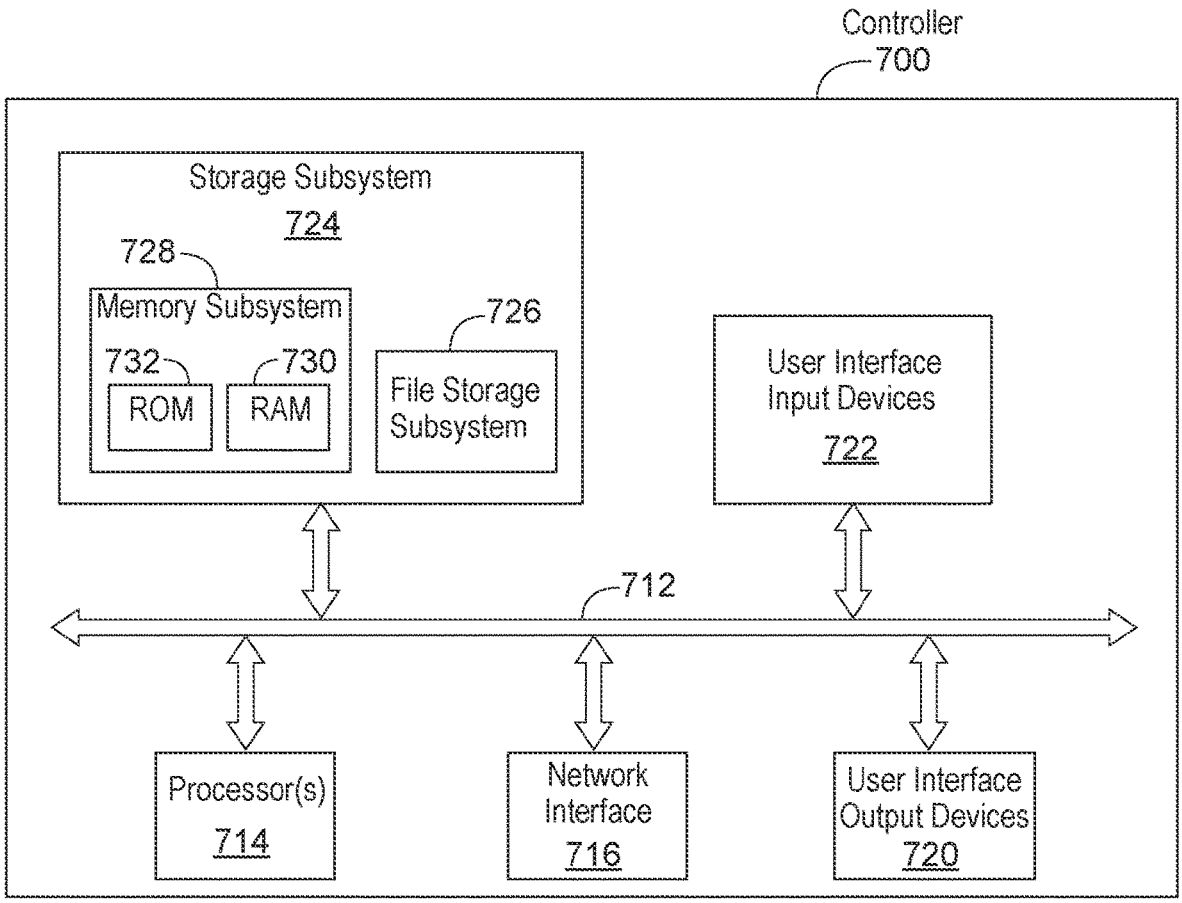
FIG. 7 illustrates a block diagram of an example embodiment of a controller that can be used in the system of FIG. 1.

FIG. 7 illustrates a block diagram of an example embodiment of a controller 700 that can be used in the system 10 of FIG. 1. For example, the controller 700 (or portions thereof) may be used in one or more of the human-machine interface (HMI) 100, the edge control device 200, the gateway coordinator device 300, or the robot controller 500. The controller 700 includes at least one processor 714 (e.g., a central processing unit, a graphics processing unit) which communicates with a number of peripheral devices via bus subsystem 712. These peripheral devices may include a storage subsystem 724, including, for example, a memory subsystem 728 and a file storage subsystem 726, user interface input devices 722, user interface output devices 720, and a network interface subsystem 716. The input and output devices allow user interaction with the controller 700. Network interface subsystem 716 provides an interface to outside networks and is coupled to corresponding interface devices in other devices.

User interface input devices 722 may include a keyboard, pointing devices such as a mouse, trackball, touchpad, or graphics tablet, a scanner, a touchscreen incorporated into the display, audio input devices such as voice recognition systems, microphones, and/or other types of input devices. In general, use of the term "input device" is intended to include all possible types of devices and ways to input information into the controller 700 or onto a communication network.

User interface output devices 720 may include a display subsystem, a printer, a fax machine, or non-visual displays such as audio output devices. The display subsystem may include a cathode ray tube (CRT), a flat-panel device such as a liquid crystal display (LCD), a projection device, or some other mechanism for creating a visible image. The display subsystem may also provide non-visual display such as via audio output devices. In general, use of the term "output device" is intended to include all possible types of devices and ways to output information from the controller 700 to the user or to another machine or computer system.

Storage subsystem 724 stores programming and data constructs that provide some or all of the functionality described herein. For example, computer-executable instructions and data are generally executed by processor 714 alone or in combination with other processors. Memory 728 used in the storage subsystem 724 can include a number of memories including a main random access memory (RAM) 730 for storage of instructions and data during program execution and a read only memory (ROM) 732 in which fixed instructions are stored. A file storage subsystem 726 can provide persistent storage for program and data files, and may include a hard disk drive, a floppy disk drive along with associated removable media, a CD-ROM drive, an optical drive, or removable media cartridges. The computer-executable instructions and data implementing the functionality of certain embodiments may be stored by file storage subsystem 726 in the storage subsystem 724, or in other machines accessible by the processor(s) 714.

Bus subsystem 712 provides a mechanism for letting the various components and subsystems of the controller 700 communicate with each other as intended. Although bus subsystem 712 is shown schematically as a single bus, alternative embodiments of the bus subsystem may use multiple buses.

The controller 700 can be of varying types. Due to the ever-changing nature of computing devices and networks, the description of the controller 700 depicted in FIG. 7 is intended only as a specific example for purposes of illustrating some embodiments. Many other configurations of the controller are possible, having more or fewer components than the controller 700 depicted in FIG. 7.

While the disclosed embodiments have been illustrated and described in considerable detail, it is not the intention to restrict or in any way limit the scope of the appended claims to such detail. It is, of course, not possible to describe every conceivable combination of components or methodologies for purposes of describing the various aspects of the subject matter. Therefore, the disclosure is not limited to the specific details or illustrative examples shown and described. Thus, this disclosure is intended to embrace alterations, modifications, and variations that fall within the scope of the appended claims, which satisfy the statutory subject matter requirements of 35 U.S.C. § 101. The above description of specific embodiments has been given by way of example. From the disclosure given, those skilled in the art will not only understand the general inventive concepts and attendant advantages, but will also find apparent various changes and modifications to the structures and methods disclosed. It is sought, therefore, to cover all such changes and modifications as fall within the spirit and scope of the general inventive concepts, as defined by the appended claims, and equivalents thereof.

What is claimed is:

1. A die casting spray system, comprising:

a human-machine interface;

an edge control device including a programmable logic controller;

a gateway coordinator device creating a mesh network that is closed to devices that do not have an identifier of the gateway coordinator device; and a (Programmable Networked Variable Atomizer) PNVA system including a plurality of (Programmable Networked Variable Atomizer) PNVA assemblies mounted to a distribution system of manifold blocks having passageways for air and lubricating fluids.

2. The die casting spray system of claim 1, wherein the gateway coordinator device includes a microprocessor, a printed circuit board, a mesh network device, and a communication module.

3. The die casting spray system of claim 1, wherein each PNVA assembly of the plurality of PNVA assemblies is controlled wirelessly through the mesh network created by the gateway coordinator device.

4. The die casting spray system of claim 1, wherein each PNVA assembly of the plurality of PNVA assemblies receives wired electrical power and ground via the distribution system of manifold blocks.

5. The die casting spray system of claim 1, wherein the mesh network is a 2.4 Ghz network.

6. The die casting spray system of claim 1, wherein a user can assign individual identifiers of the plurality of PNVA assemblies to the identifier of the gateway coordinator device either by pushing the momentary push button or by using a unique MAC address.

7. The die casting spray system of claim 1, wherein each PNVA assembly of the plurality of PNVA assemblies includes an atomizing portion and a PNVA electronic module.

8. The die casting spray system of claim 7, wherein the PNVA electronic module includes a microcontroller, at least one pulse width modulation driver, a wireless radio, a differential pressure sensor, a laser targeting LED, a diagnostic LED, and a momentary pushbutton.

9. The die casting spray system of claim 7, wherein the atomizing portion includes a plurality of miniature fluid control valves and an air assisted atomizing outlet.

10. The die casting spray system of claim 9, wherein a pattern of working fluids output by the air assisted atomizing outlet of each PNVA assembly of the plurality of PNVA assemblies can be set independently, regardless of physical position on the distribution system of manifold blocks.

* * * * *